US009840994B2

(12) United States Patent
Zhang

(10) Patent No.: US 9,840,994 B2
(45) **Date of Patent: *Dec. 12, 2017**

(54) ANNULUS NOZZLE INJECTOR WITH TANGENTIAL FINS

(71) Applicant: Ford Global Technologies, LLC, Dearborn, MI (US)

(72) Inventor: Xiaogang Zhang, Novi, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 92 days.

This patent is subject to a terminal disclaimer.

(21) Appl. No.: 14/932,780

(22) Filed: Nov. 4, 2015

(65) Prior Publication Data

US 2017/0122276 A1 May 4, 2017

(51) Int. Cl.
*F02M 51/06* (2006.01)
*F02D 41/26* (2006.01)

(52) U.S. Cl.
CPC ..... *F02M 51/06* (2013.01); *F02D 41/26* (2013.01)

(58) Field of Classification Search
CPC .. F02M 61/18; F02M 61/1806; F02M 61/182; F02M 61/1846; F02M 61/1893; F02M 51/06; F02D 41/26; F02D 41/30; F02D 41/34
USPC ..... 701/103, 104
See application file for complete search history.

(56) References Cited

U.S. PATENT DOCUMENTS 3,339,848 A * 9/1967 Geiger ..... F02M 45/086 239/453
4,559,009 A * 12/1985 Marino ..... F23D 11/14 239/402.5
5,551,391 A * 9/1996 Beck ..... F02M 47/02 123/300
6,109,540 A * 8/2000 Coldren ..... F02M 61/08 239/87
6,585,171 B1 * 7/2003 Boecking ..... F02M 51/0603 239/102.1
6,748,872 B2 * 6/2004 Parrish ..... F02B 61/045 123/305
7,527,041 B2 * 5/2009 Wing ..... F02M 51/0603 123/478
8,074,625 B2 12/2011 McAlister
8,091,805 B2 1/2012 Paterson
8,613,400 B2 12/2013 Filicicchia et al.
(Continued)

FOREIGN PATENT DOCUMENTS

WO 2014052126 A1 4/2014
WO 2015024139 A1 2/2015

OTHER PUBLICATIONS

Zhang, Xiaogang, "Annulus Nozzle Injector With Tangential Fins," U.S. Appl. No. 14/932,824, filed Nov. 4, 2015, 50 pages.

*Primary Examiner* — Carlos A Rivera
*Assistant Examiner* — Anthony Taylor, Jr.
(74) *Attorney, Agent, or Firm* — Julia Voutyras; McCoy Russell LLP

(57) ABSTRACT

Methods and systems are provided for direct fuel injection, wherein a fuel injector comprises an injector needle coupled to a frustum shaped nozzle. During a fuel injection event, the injector needle may be moved outward to create an annulus nozzle. In this way, the fuel injector may inject fuel with a cone shaped spray pattern, reducing the spray penetration of the injected fuel.

18 Claims, 11 Drawing Sheets

(56) References Cited

U.S. PATENT DOCUMENTS

| | | | | |
|---|---|---|---|---|
| 8,919,377 | B2 * | 12/2014 | McAlister | F16K 15/16<br>137/599.03 |
| 2005/0150978 | A1 * | 7/2005 | Kaden | F02M 61/08<br>239/453 |
| 2014/0069371 | A1 * | 3/2014 | Berkemeier | F02M 39/00<br>123/294 |
| 2014/0216405 | A1 | 8/2014 | Kato | |

* cited by examiner

ANNULUS NOZZLE INJECTOR WITH TANGENTIAL FINS

FIELD

The present description relates generally to systems and methods for a direct fuel injector for an internal combustion engine.

BACKGROUND/SUMMARY

Internal combustion engines may utilize direct fuel injection, wherein fuel is directly injected in to an engine cylinder, to improve fuel gas mixing. In traditional direct fuel injectors, the injector nozzle hole configuration and geometry can regulate combustion characteristics and effect vehicle emissions. The fuel is typically injected from a sac at the tip of the fuel injector needle into the engine cylinder through a plurality of holes, configured in various forms to increase atomization and improve air-fuel mixing.

One example approach for improving air-fuel mixing with a direct injector is shown by Abani et al. in WO2014052126. Therein, an injector nozzle comprises a plurality of holes skewed with respect to the axis of the injector in order to impart an angular momentum on a plume of injected fuel.

However, the inventors herein have recognized some issues with the above fuel injector. For example, because the fuel is ejected out of the nozzle at high pressure, the fuel may have a relatively long spray penetration, despite the swirl imparted by the skewed nozzle holes. As a result, the fuel may impinge upon the cylinder walls. Particularly during cold engine conditions, the fuel on the cylinder wall may not participate in combustion, leading to fueling errors and compromising emissions. In another example, the sac at the base of the injector needle is in communication with the cylinder through the nozzle holes even after the injector is in a closed position. The residual volume of fuel from the sac can thus drip into the cylinder after the injector is closed, which may result in injector coking. This can degrade fuel spray pattern and vehicle emissions. Prolonged buildup due to fuel dripping can also decrease the effective flow area of the nozzle holes, decreasing the efficiency of fuel injection, and consequently, a reduction in engine power and/or torque may be observed.

Thus, a fuel injector is presented herein to at least partly address the above issues. In one example, the fuel injector comprises a needle and a frustum shaped nozzle end coupled to the needle. In this way, the fuel may travel over the frustum-shaped nozzle end when the fuel is injected out of the injector, atomizing the fuel to promote mixing and imparting rotational momentum to the fuel spray.

In one example, the nozzle end of the needle may include a plurality of tangential fins positioned on an outer surface of the frustum. Further, the tangential fins may be curved, for example in a counter-clockwise direction. To inject fuel, the needle may be moved outward, away from the center of the injector and into a cylinder to which the fuel injector is coupled. In this way, an annulus nozzle may be created between a body of the injector housing the needle and the frustum-shaped nozzle end of the needle. The fuel flowing out of the injector travels over the frustum-shaped nozzle end and curved tangential fins. In doing so, fuel is injected with a cone shaped-spray and a swirl motion may be imparted to the fuel spray via the curved fins, thus reducing the spray penetration and cylinder wall wetting. Further, air-fuel mixing may be increased.

In another embodiment, the fuel injector may have two injector needles, a primary injector needle and a secondary injector needle, where the secondary injector needle is coupled to the frustum shaped nozzle end. A fuel chamber (e.g., sac) may be located in a space between the primary needle and the secondary needle. An electric actuator may be used to move the primary injector needle to establish fluidic communication between a fuel passage and the fuel chamber. Once sufficient pressure is reached in the fuel chamber, the secondary needle may be actuated via the fuel pressure to create the annulus nozzle over which the fuel travels to the cylinder. In another embodiment of the fuel injector, the secondary injector needle nozzle end may have a plurality of curved fins on its surface. The curved fins may provide rotational momentum to the injector nozzle to reduce fuel penetration and increase air-fuel mixing.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
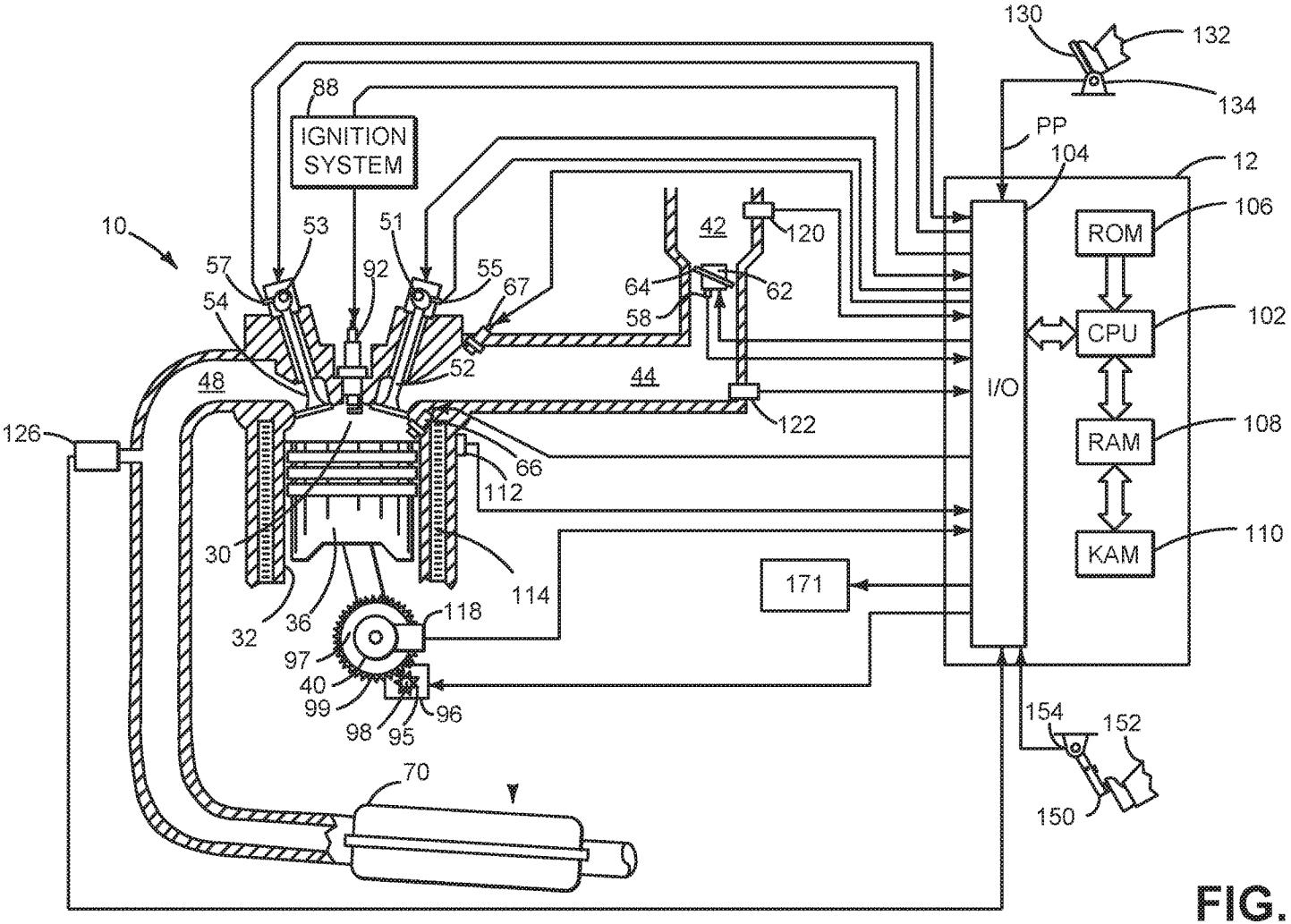
FIG. 1 shows a schematic depiction of an internal combustion engine.
Figure 2:
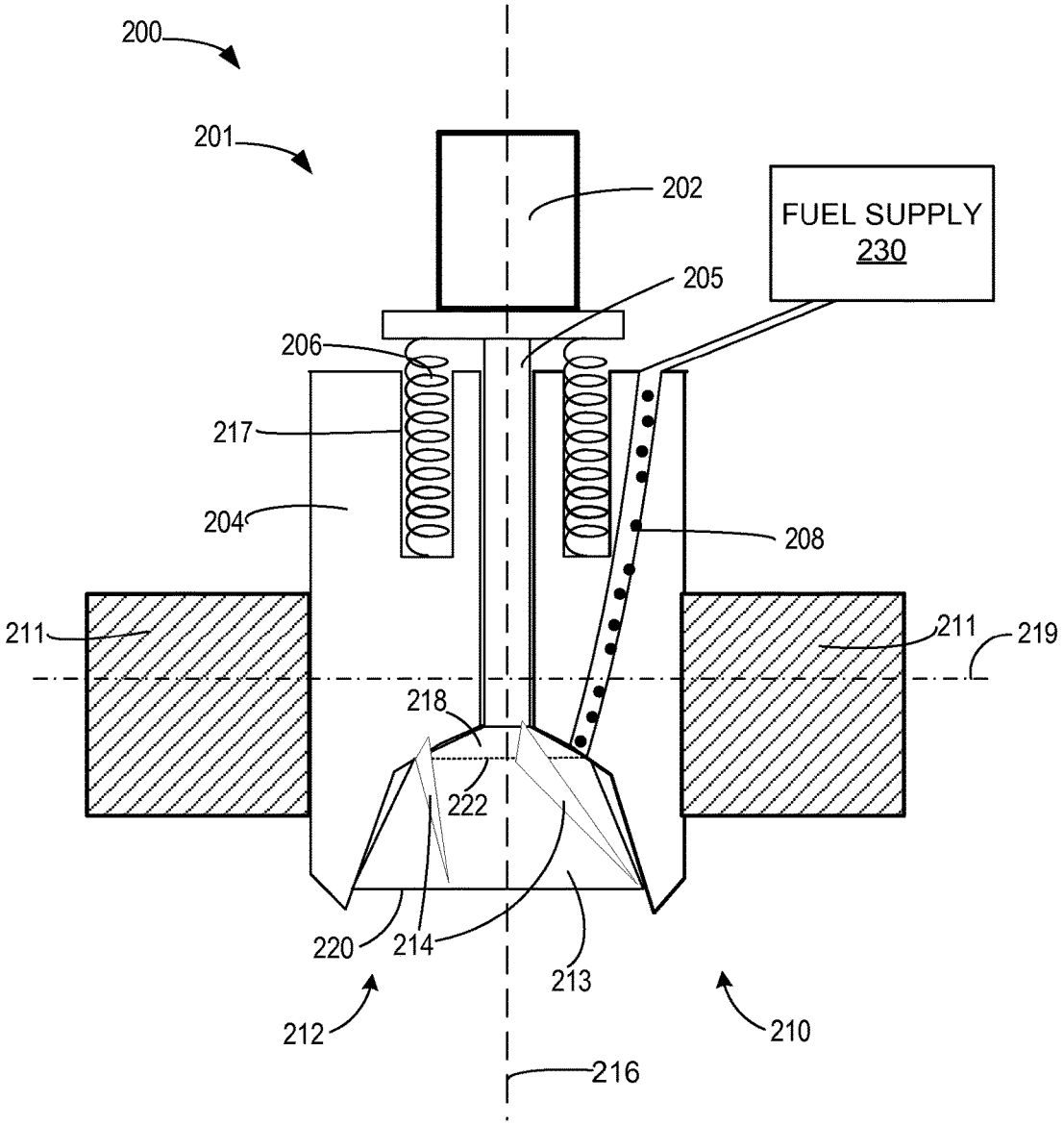
FIG. 2 shows an example of a direct fuel injector assembly used in the engine of FIG. 1 in a deactivated position.
Figure 3:
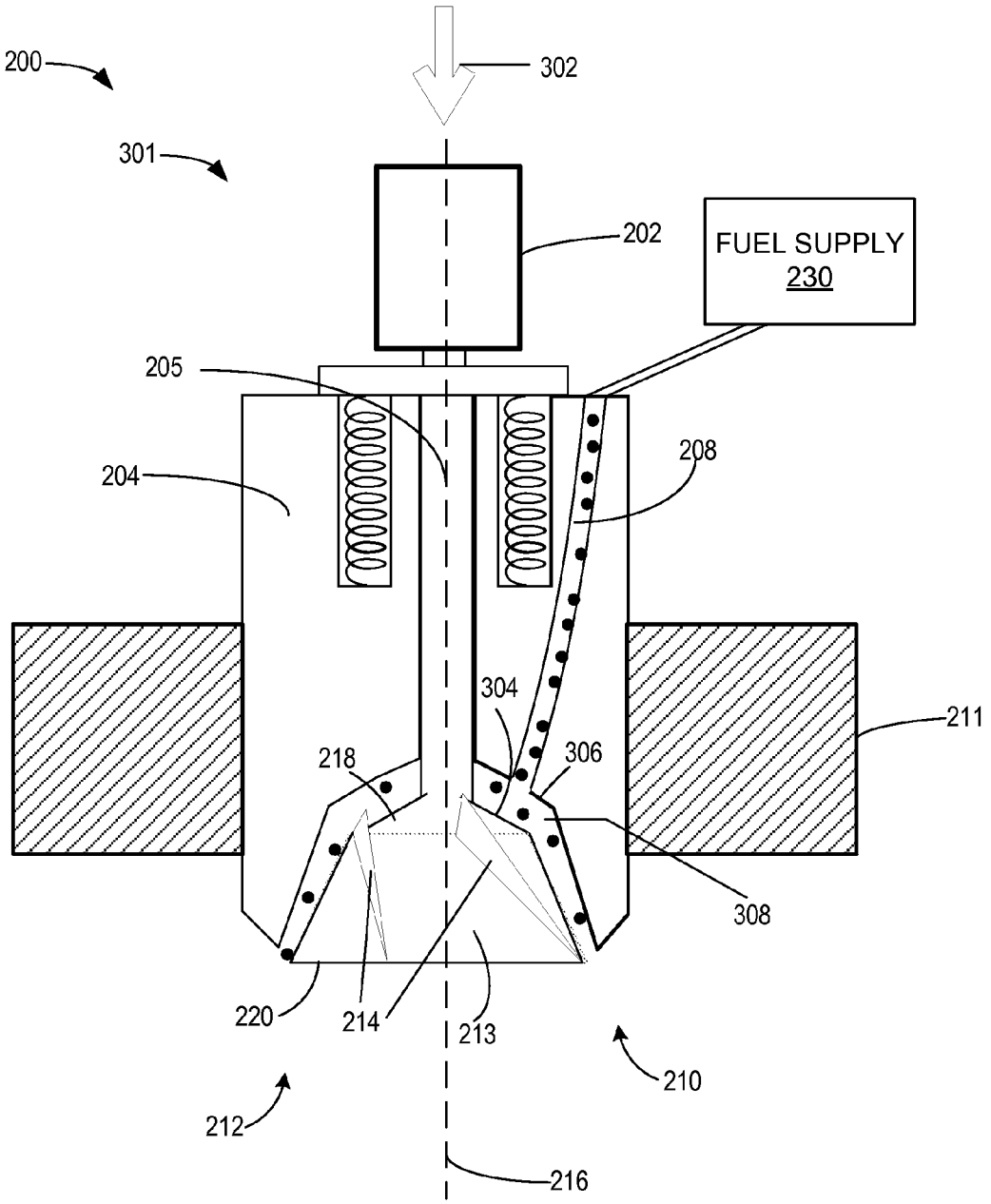
FIG. 3 shows an example of the fuel injector assembly in an activated position.
Figure 6:
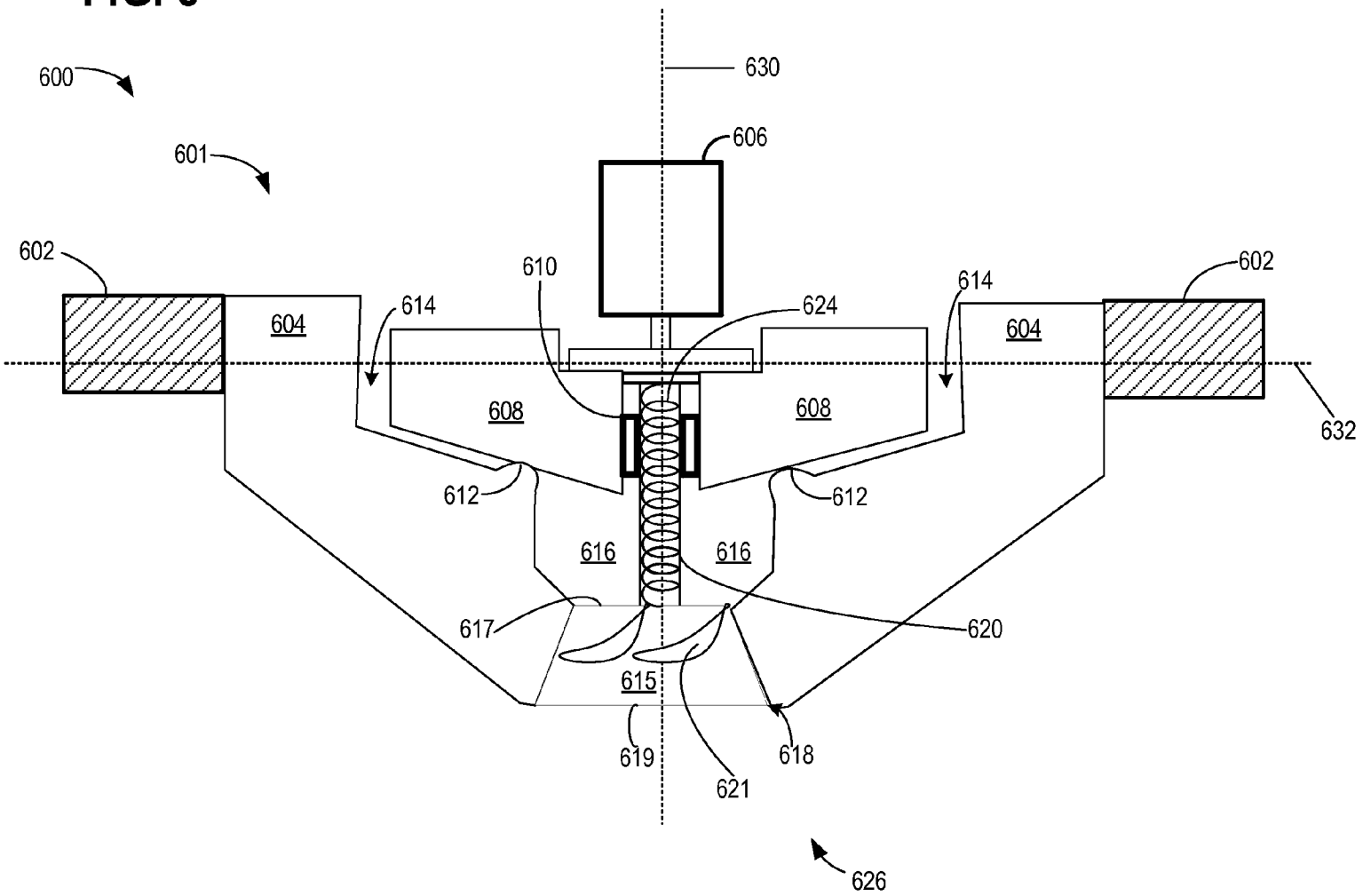
FIG. 6 shows an embodiment of a direct fuel injector assembly with two injector needles and a nozzle end with a plurality of curved fins in a deactivated first position.
Figure 7:
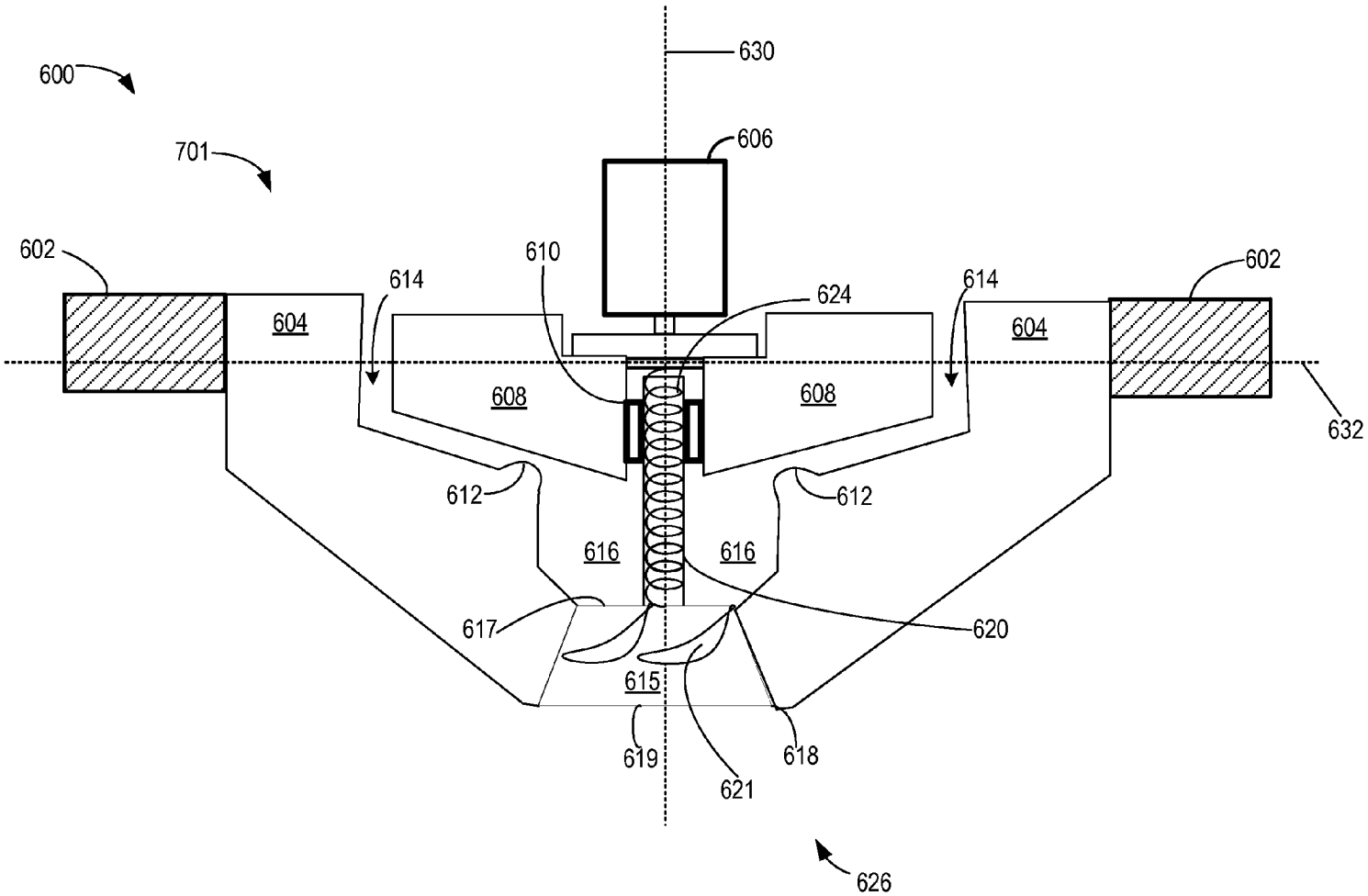
FIG. 7 shows the fuel injector assembly of FIG. 6 in an activated second position.
Figure 8:
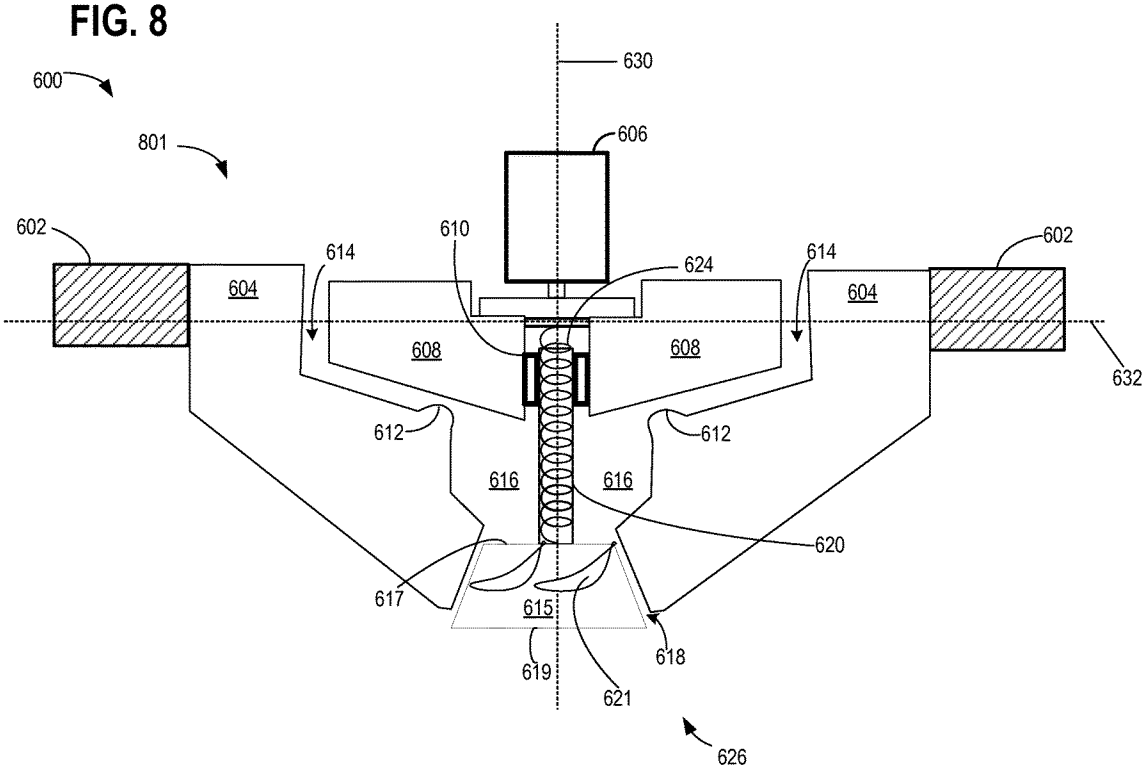
FIG. 8 shows the fuel injector assembly of FIG. 6 in an activated third position.
Figure 9:
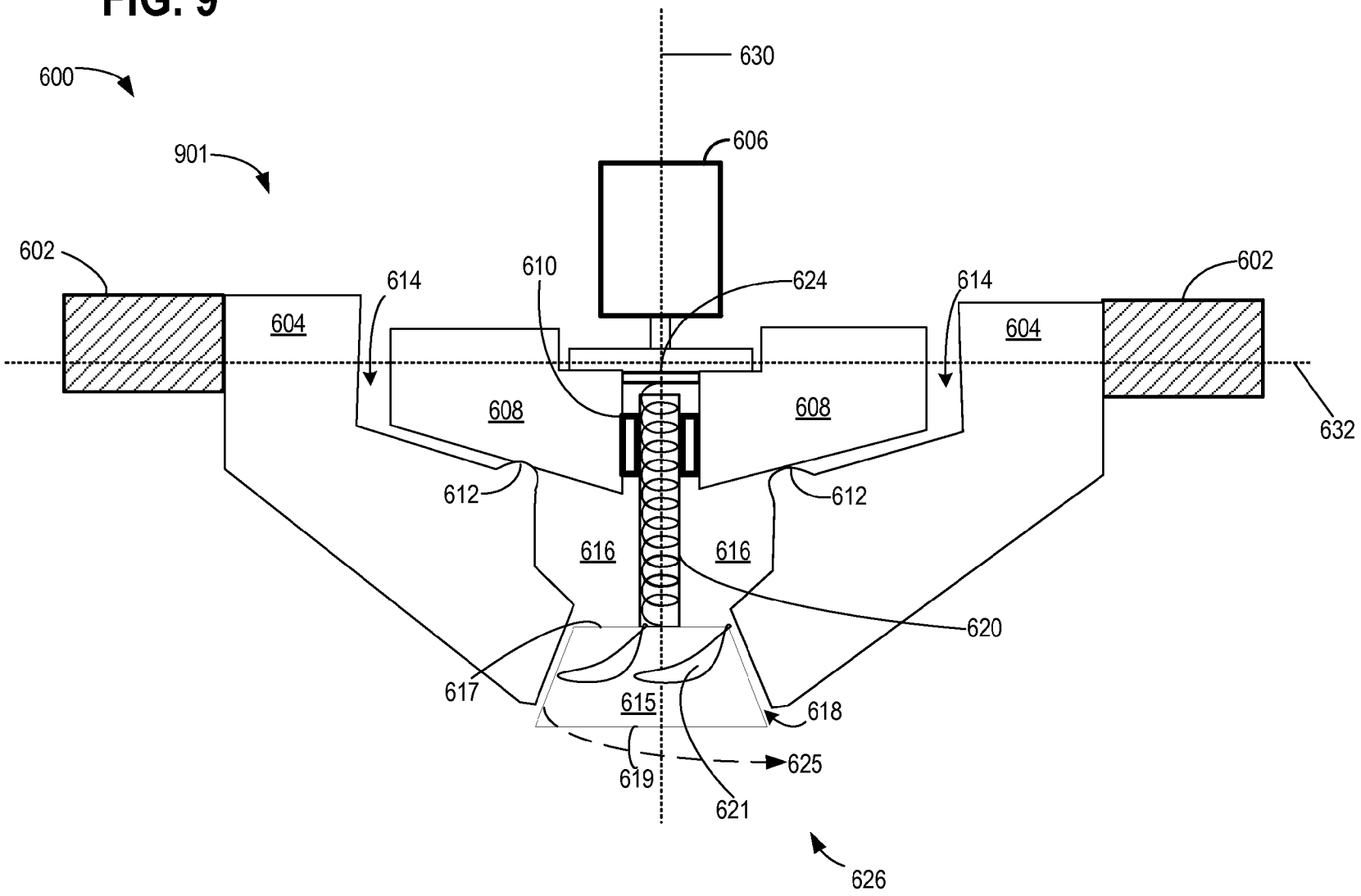
FIG. 9 illustrates the fuel injector assembly of FIG. 6 in a deactivated fourth position.
Figure 10:
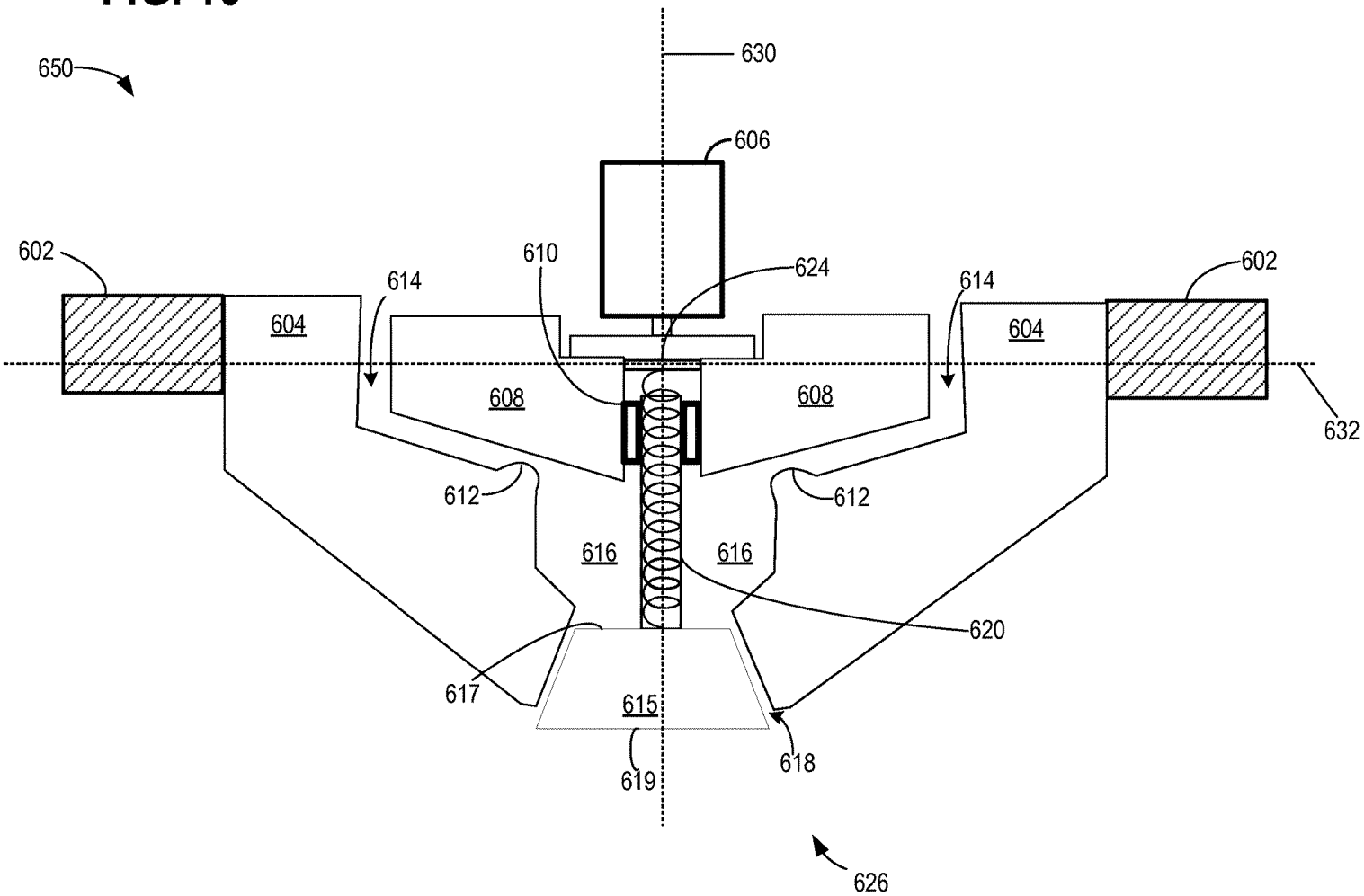
FIG. 10 depicts an embodiment of a direct fuel injector assembly of FIG. 6 with a nozzle end without curved fins in an activated third position.
Figure 11:
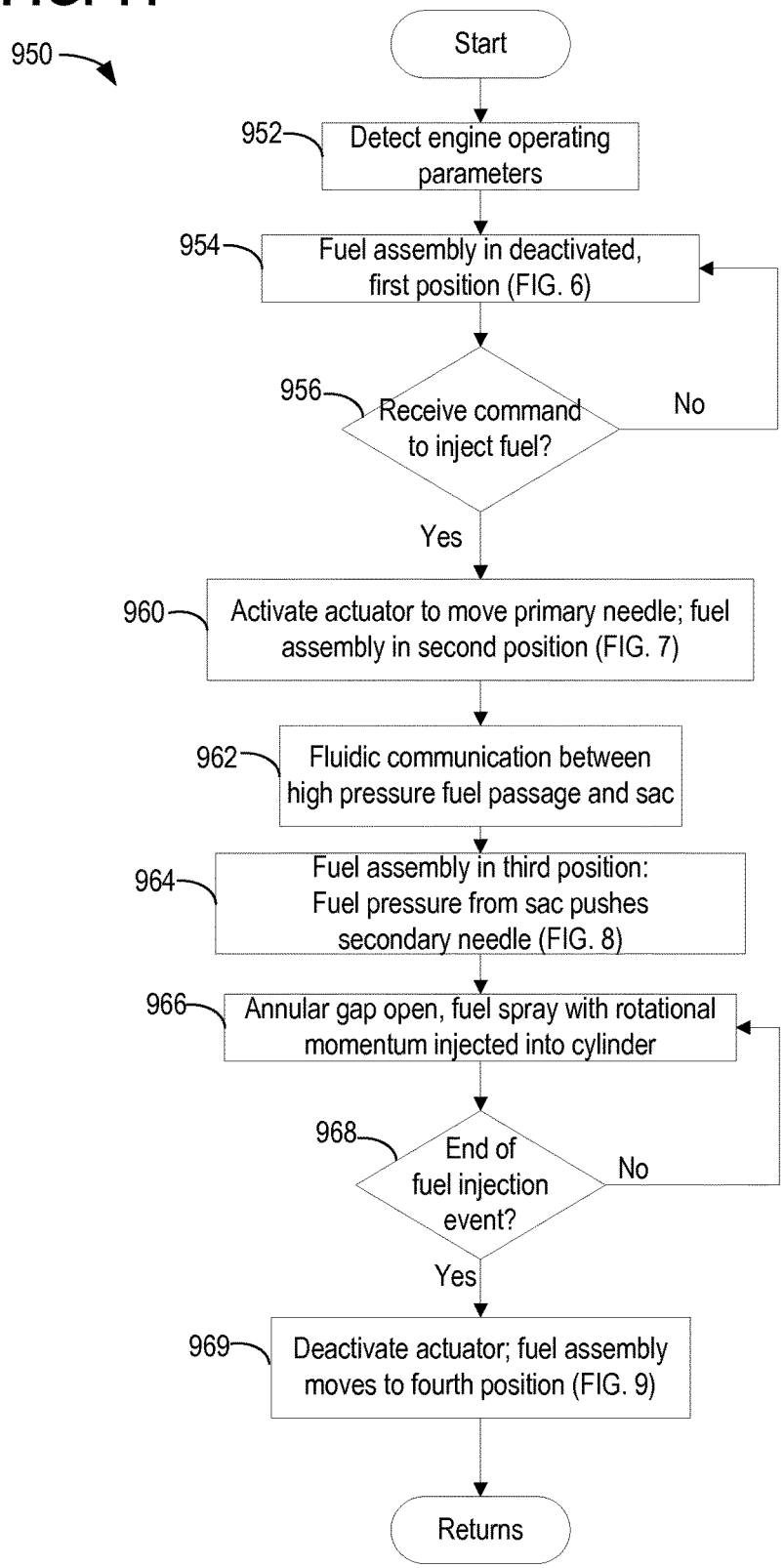
FIG. 11 is a flowchart showing a method for operating a fuel injector assembly of FIG. 6.

The following description relates to systems and methods for adjusting the operation of a direct fuel injector which may be incorporated in an engine as shown in FIG. 1. An engine controller may send control signals to an electric actuator coupled to a needle and nozzle of the direct fuel injector to adjust the position of the nozzle, as shown in FIGS. 2 and 3. The controller may perform a control routine, such as the example routine of FIG. 5, to transition the nozzle from a default position where a fuel passage is held closed, to a position where the nozzle is moved into a combustion chamber to open the fuel passage. Tangential fins on the surface of the nozzle (FIG. 4) are additionally used to generate a cone shaped fuel spray having rotational momentum which allows for efficient air fuel mixing. FIGS. 6-9 describe an embodiment of a fuel injector assembly with two injector needles, going through a two-stage activation and a two-stage deactivation process to regulate fuel injection. FIG. 6 shows a first position of the deactivated fuel injector assembly. FIG. 7 shows the activated fuel injector assembly in a second position followed by another activation stage when the fuel injector assembly is in a third position, as illustrated in FIG. 8. The fourth position of the deactivated fuel injector assembly is shown in FIG. 9. FIG. 10 shows the fuel injector assembly of FIG. 6 without curved fins in an activated third position and FIG. 11 depicts a method for injecting fuel by the fuel injector assembly described in FIGS. 6-10.

Referring to FIG. 1, internal combustion engine 10, comprising a plurality of cylinders, one cylinder of which is shown in FIG. 1, is controlled by electronic engine controller 12. Engine 10 includes combustion chamber 30 and cylinder walls 32 with piston 36 positioned therein and connected to crankshaft 40. Flywheel 97 and ring gear 99 are coupled to crankshaft 40. Starter 96 includes pinion shaft 98 and pinion gear 95. Pinion shaft 98 may selectively advance pinion gear 95 to engage ring gear 99. Starter 96 may be directly mounted to the front of the engine or the rear of the engine. In some examples, starter 96 may selectively supply torque to crankshaft 40 via a belt or chain. In one example, starter 96 is in a base state when not engaged to the engine crankshaft. Combustion chamber 30 is shown communicating with intake manifold 44 and exhaust manifold 48 via respective intake valve 52 and exhaust valve 54. Each intake and exhaust valve may be operated by an intake cam 51 and an exhaust cam 53. The position of intake cam 51 may be determined by intake cam sensor 55. The position of exhaust cam 53 may be determined by exhaust cam sensor 57.

Cylinder 30 includes two fuel injectors 66 and 67. Direct fuel injector 66 is shown positioned to inject fuel directly into cylinder 30, which is known to those skilled in the art as direct injection. Fuel injector 66 delivers liquid fuel in proportion to a voltage pulse width or fuel injector pulse width of a signal from controller 12. Fuel is delivered to fuel injector by a fuel system (not shown) including a fuel tank, fuel pump, and fuel rail (not shown). In addition, intake manifold 44 is shown communicating with optional electronic throttle 62 which adjusts a position of throttle plate 64 to control air flow from air intake 42 to intake manifold 44. Distributorless ignition system 88 provides an ignition spark to combustion chamber 30 via spark plug 92 in response to controller 12. Universal Exhaust Gas Oxygen (UEGO) sensor 126 is shown coupled to exhaust manifold 48 upstream of catalytic converter 70. Alternatively, a two-state exhaust gas oxygen sensor may be substituted for UEGO sensor 126.

Converter 70 can include multiple catalyst bricks, in one example. In another example, multiple emission control devices, each with multiple bricks, can be used. Converter 70 can be a three-way type catalyst in one example.

Controller 12 is shown in FIG. 1 as a conventional microcomputer including: microprocessor unit 102, input/output ports 104, read-only memory 106 (e.g., non-transitory memory), random access memory 108, keep alive memory 110, and a conventional data bus. Controller 12 is shown receiving various signals from sensors coupled to engine 10, in addition to those signals previously discussed, including: engine coolant temperature (ECT) from temperature sensor 112 coupled to cooling sleeve 114; a position sensor 134 coupled to an accelerator pedal 130 for sensing force applied by foot 132; a position sensor 154 coupled to brake pedal 150 for sensing force applied by foot 152, a measurement of engine manifold pressure (MAP) from pressure sensor 122 coupled to intake manifold 44; an engine position sensor from a Hall effect sensor 118 sensing crankshaft 40 position; a measurement of air mass entering the engine from sensor 120; and a measurement of throttle position from sensor 58. Barometric pressure may also be sensed (sensor not shown) for processing by controller 12. In a preferred aspect of the present description, engine position sensor 118 produces a predetermined number of equally spaced pulses every revolution of the crankshaft from which engine speed (RPM) can be determined.

In some examples, the engine may be coupled to an electric motor/battery system in a hybrid vehicle. Further, in some examples, other engine configurations may be employed, for example a diesel engine with multiple fuel injectors. Further, controller 12 may communicate conditions such as degradation of components to light, or alternatively, display panel 171.

During operation, each cylinder within engine 10 typically undergoes a four stroke cycle: the cycle includes the intake stroke, compression stroke, expansion stroke, and exhaust stroke. During the intake stroke, generally, the exhaust valve 54 closes and intake valve 52 opens. Air is introduced into combustion chamber 30 via intake manifold 44, and piston 36 moves to the bottom of the cylinder so as to increase the volume within combustion chamber 30. The position at which piston 36 is near the bottom of the cylinder and at the end of its stroke (e.g., when combustion chamber 30 is at its largest volume) is typically referred to by those of skill in the art as bottom dead center (BDC). During the compression stroke, intake valve 52 and exhaust valve 54 are closed. Piston 36 moves toward the cylinder head so as to compress the air within combustion chamber 30. The point at which piston 36 is at the end of its stroke and closest to the cylinder head (e.g. when combustion chamber 30 is at its smallest volume) is typically referred to by those of skill in the art as top dead center (TDC). In a process hereinafter referred to as injection, fuel is introduced into the combustion chamber. In a process hereinafter referred to as ignition, the injected fuel is ignited by known ignition means such as spark plug 92, resulting in combustion. During the expansion stroke, the expanding gases push piston 36 back to BDC. Crankshaft 40 converts piston movement into a rotational torque of the rotary shaft. Finally, during the exhaust stroke, the exhaust valve 54 opens to release the combusted air-fuel mixture to exhaust manifold 48 and the piston returns to TDC. Note that the above is shown merely as an example, and that intake and exhaust valve opening and/or closing timings may vary, such as to provide positive or negative valve overlap, late intake valve closing, or various other examples.

As explained above, a direct fuel injector may be used to supply fuel directly to a cylinder of an engine, as shown in FIG. 1. To increase atomization of the fuel, direct injectors may include a plurality of holes through which the fuel is supplied. Because the fuel is supplied to the direct injector at a high pressure, the fuel is typically injected from the direct injector with relatively high force. This may cause the fuel to impinge on the walls of the cylinder. Particularly during cold engine conditions, the fuel that hits the surface of the cylinders may not participate in combustion. This cylinder wall-wetting can cause fueling errors, leading to misfire or other combustion stability issues, and can also compromise emissions. According to embodiments described below, a fuel injector may have an injector needle that includes a frustum-shaped end with a plurality of curved fins. During fuel injection, the injector needle may be moved outward (e.g., into the cylinder) to create an annulus nozzle through which fuel flows. The fuel may flow over the frustum-shaped end and curved fins, creating a cone-shaped fuel spray having rotational momentum. In this way, fuel atomization may be provided while maintaining the fuel spray within a region proximate the injector and away from the walls of the cylinder.

Referring to FIGS. 2 and 3, an example of a fuel injector assembly 200 in an engine cylinder 210 defined by a cylinder head 211 is illustrated. The fuel injector assembly 200 may be one nonlimiting example of injector 66 of FIG. 1. The fuel injector assembly 200 includes an injector body 204 housing an injector needle 205 in a movable manner along a longitudinal axis 216 of the injector body 204. The injector body 204 also houses a fuel passage 208 coupled to a fuel supply 230 (e.g., a high pressure common fuel rail, fuel supply line(s), fuel pump(s), and fuel tank). The fuel passage 208 has an outlet for fuel discharge into an annular gap 308 created when an actuator 202 moves the injector needle 205 in a downward direction for delivery of fuel to the engine cylinder (shown in FIG. 3). The actuator 202 may be coupled to the injector needle 205. In one embodiment of the disclosed device, an electric motor is used to move the needle to regulate fuel injection. The fuel injector may be actuated by other actuators, such as solenoid, piezoelectric, hydraulic, etc., without departing from the scope of this disclosure.

The injector needle is also coupled to one or more retention springs 206. Each retention spring 206 may insert into a groove 217 in the injector body 204 and act to bias the injector needle 205 in an upward direction (e.g., away from the cylinder 210). The actuator 202 may move the needle 205 along the longitudinal axis in a downward direction (e.g., toward the cylinder 210), against the force of the springs. In the example illustrated in FIGS. 2 and 3, the longitudinal axis of the injector is perpendicular to a transverse axis 219 of the cylinder 210. However, in other examples the injector may be positioned at a different angle relative to the transverse axis.

The fuel injector needle 205 has a frustum shaped nozzle end 212 coupled to the needle 205 via a sloped connecting region 218. The nozzle end 212 includes a top surface 222 coupled to the sloped connecting region 218 and a bottom surface 220 opposite the top surface. The bottom surface 220 faces into the interior of the cylinder 210. The bottom surface 220 may have a larger cross-sectional area than the cross-sectional area of the top surface. The frustum may have a conical shape, in which the top and bottom surfaces are circular or oval. However, other shapes are possible, such as rectangular. Further, it is to be understood that in some examples, the nozzle end 212, sloped connecting region 218, and needle 205 may be comprised of a single continuous piece, while in other examples, one or more of the nozzle end 212, sloped connecting region 218, and needle 205 may be comprised of separate pieces fastened together.

The top surface 222 of the nozzle end is coupled to the bottom surface 220 via an outer surface 213. Because the bottom surface of the frustum-shaped nozzle is larger in cross-sectional area than the top surface, the outer surface may slope outward, away from the centerline (e.g., longitudinal axis) of the injector.

The injector body 204 includes a needle seat having an inner surface sized and shaped such that at least a portion of the inner surface is in face-sharing contact with at least a portion of the nozzle end when the needle is in a first, closed position. For example, the inner wall of the injector body includes one or more angled inner surfaces 306 that are shaped to at least approximately correspond to the shape of the frustum and sloped connecting region, such that when the injector is held in its default, closed position (e.g., when the actuator is not activated), the outer surface 213 of the nozzle end and/or the sloped connecting region 218 is in face-sharing contact with one or more of the angled inner surfaces 306. In particular, a surface 304 of the nozzle end and/or sloped connecting region acts to seal the fuel passage 208 when surfaces 304 and 306 are in face-sharing contact. The face-sharing between two surfaces may be partial or complete, which may depend on the shape of the nozzle and the shape of the inner wall of the injector body and on the position of the injector nozzle relative to the injector body inner wall.

FIG. 2 shows the fuel injector assembly 200 in a first position 201 wherein actuator 202 is not activated and the springs bias the needle and nozzle end upward into face-sharing contact with the inner wall of the injector body. Accordingly, fuel is blocked from exiting the fuel passage 208 and no fuel injection occurs.

FIG. 3 shows the fuel injector assembly 200 in a second position 301 wherein actuator 202 is activated and forces the needle and nozzle end downward (e.g., into the cylinder) against the force of the springs. The nozzle end moves outward, into the cylinder, and the fuel passage 208 is no longer blocked. Further, the movement of the nozzle away from the injector body creates an annulus gap 308 between the inner surfaces of the injector body and the outer surfaces of the nozzle end through which fuel can flow out of the fuel passage.

Figure 4:
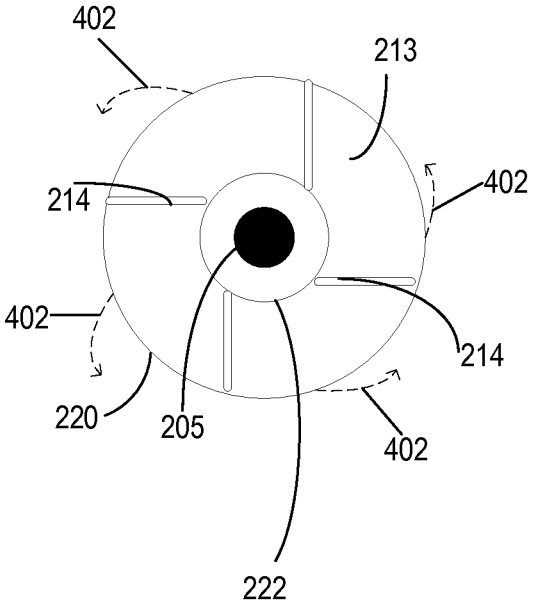
FIG. 4 is a top-down view of the spray nozzle and the tangential fins.

The injector nozzle end 212 includes a plurality of tangential curved fins 214 coupled to the outer surface 213, positioned at a tangent to a circle created by a plane through the nozzle end, such as a plane through the top surface 222. FIG. 4 shows a top down view of the nozzle end 212 with the tangential orientation of the curved fins 214 on the outer surface 213 of the frustum. The top down view shows the injector needle 205 at the center, with a view of the four evenly spaced fins 214 on the outer surface of the frustum shaped nozzle end 212 and positioned tangentially with respect to top surface 222. When the actuator moves the nozzle end away from the injector body and fuel travels through the fuel passage 208 to the annulus gap 308, fuel travels over the outer surface of the nozzle end and the plurality of curved fins. The fins are curved in such a manner to create a fuel spray having rotational momentum in a counter-clockwise direction, as shown by arrow 402. The spray may travel in a counter-clockwise direction with respect to the circular bottom surface of the nozzle end when the injector is viewed from top-down, as shown in FIG. 4. In some examples, such as when the fuel injector is positioned between the cylinder wall and the intake port of the cylinder (as illustrated in FIG. 1), the intake air may be inducted into the cylinder with a swirl also having a counter-clockwise directional rotation (with respect to the cylinder crown when viewed from top-down, for example). By providing the fuel spray in a counter-clockwise direction, the fuel spray may be entrained by the swirling intake air, promoting mixing of the fuel with the intake air.

While four curved fins are shown in FIG. 4, other embodiments may have more than four, or less than four tangential fins spaced at equal or unequal intervals on the outer wall of the nozzle, such that the fuel spray may change in mass distribution and pattern, effecting the air fuel mix. For example, depending on engine bore diameter and calibration, the number of fins may 4, 6, 8 or other suitable number. More fins may help to reduce the spray penetration by introducing stronger rotation. However, the larger the number of fins present, the less quantity fuel can be delivered. As a result, more fins may be utilized in an engine with a smaller bore size.

Figure 5:
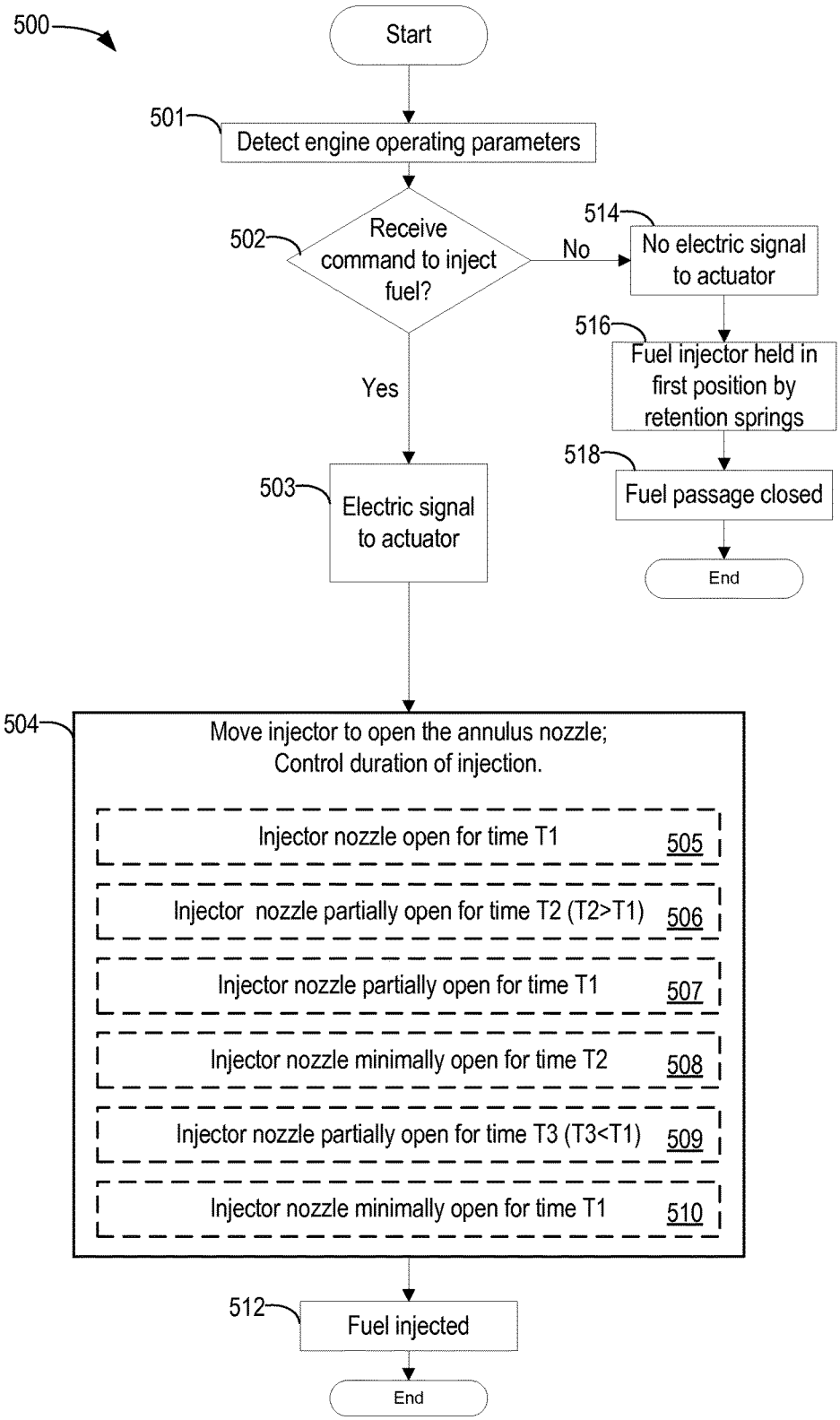
FIG. 5 depicts a flow chart of a method of operating a direct fuel injector and controlling the volume of fuel injection by an actuator.

FIG. 5 is a flow chart illustrating a method 500 for injecting fuel with a direct fuel injector, such as the fuel injector assembly 200 of FIGS. 2-4. At least portions of method 500 may be implemented as executable controller instructions stored in non-transitory memory. Additionally, portions of method 500 may be actions taken in the physical world to transform an operating state of an actuator or device, such as the actuator 202 of the fuel injector assembly. Instructions for carrying out method 500 may be executed by a controller (e.g., controller 12) based on instructions stored on a memory of the controller and in conjunction with signals received from sensors of the engine system, such as the sensors described above with reference to FIG. 1. The controller may employ engine actuators of the engine system to adjust engine operation, according to the method described below.

Method 500 starts at 501 where engine operating parameters are detected. The detected engine operating parameters may include but are not limited to engine status (e.g., on or off), engine speed and load, current engine position, engine temperature, and other parameters. At 502, method 500 determines if a command to inject fuel is received. Fuel may be injected in response to engine load above a threshold and/or in response to the firing order and engine position indicating that the injector is to inject fuel to initiate combustion in the cylinder. If the command is yes, method 500 proceeds to 503 to send a signal to an electric actuator (e.g., actuator 202) which is coupled to an injector needle (e.g., needle 205) of the fuel injector. At 504 the actuator moves the needle from a first, closed position to one of a plurality of open positions. When the needle is moved from the closed position to an open position, a nozzle end (e.g., end 212) of the needle is moved outward to create an annulus nozzle through which fuel from a fuel passage within the injector body is supplied.

The extent of outward movement of the needle and the duration for which the needle is held in that position may be controlled by the electric actuator in order to control one or more of the volume of fuel being injected and spray penetration of the injected fuel. As described above with respect to FIGS. 2 and 3, the injector needle and nozzle end may be moved to a second position to open up an annular gap, thus creating the annulus nozzle through which fuel may flow during the injection event. In one example, this second position may represent a maximally or fully open position of the injector, and the actuator may be configured to open the injector to other, intermediate positions in order to deliver smaller volumes of fuel. For example, the actuator may be configured to open the injector to a first intermediate position and to a second intermediate position, where the first intermediate position is open less than the maximally open position (e.g., the second position of FIGS. 2 and 3) but is open more than the second intermediate position. Further, the spray penetration of the fuel may be reduced by reducing the size of the annulus nozzle.

Accordingly, as illustrated in FIG. 5, when a relatively high volume of fuel is desired (e.g., during high engine load conditions), the injector may be held in the second position described above with respect to FIGS. 2 and 3 such that the annulus nozzle is maximally open for a specified time T1, injecting a relatively large volume of fuel, as indicated at 505. The same large volume of fuel may also be injected when the electric actuator holds the fuel injector needle in a partially open position, such as the first intermediate position, for a longer time T2 such that T2>T1, as indicated at 506. The partially open, first intermediate position may be a position where the needle is moved outward by a lesser amount than the second position in order to create an annulus nozzle having a smaller volume than the annulus nozzle created when the injector is in the second position. The determination of whether to actuate the needle to the fully open position for a shorter duration or to actuate the needle to the partially open, first intermediate position for a longer duration may be based on engine temperature in some examples. For example, during cold engine conditions (e.g., engine temperature at ambient temperature), fuel that impinges on the wall of the cylinder may not participate in combustion, leading to combustion stability and emissions issues. However, during warmed up engine conditions (e.g., where the engine is at normal operating temperature), the cylinder walls may be hot enough to vaporize any fuel that reaches the cylinder walls. Accordingly, controlling the fuel spray penetration may be less important during warmed up operation, and thus the fuel may be injected via the injector in the fully open position for a shorter duration. However, during cold engine conditions, the fuel may be injected via the injector in the partially open position for a longer duration to reduce the spray penetration.

In another example, when demand for fuel is moderate (e.g., during mid-load conditions), the injector needle may be actuated to the partially open, first intermediate position to open the annulus nozzle for a shorter duration T1 (at 507), or the injector needle may be actuated to the minimally open, second intermediate position for a longer duration T2 (T2>T1) (at 508), both resulting in injection of an intermediate volume of fuel. Similar to the injector control strategy described above, the fuel may be injected via the injector in the partially open, first intermediate position for a shorter duration during warmed up engine operation and the fuel may be injected via the injector in the minimally open, second intermediate position for a longer duration during cold engine conditions, to reduce the fuel spray penetration.

In one example, when fuel demand is low (e.g., during low load conditions and/or during fuel injection in a split injection event, such as the pilot injection), the injector needle may be actuated to the partially open, first intermediate position to partially open the annulus nozzle for a short duration T3 (T3<T1), as indicated at 509, or the injector needle may be actuated to the minimally open, second intermediate position for a longer duration T1 (at 510), both resulting in small volume of fuel injection. Similar to the injector control strategy described above, the fuel may be injected via the injector in the partially open first intermediate position for a shorter duration during warmed up engine operation and the fuel may be injected via the injector in the minimally open second intermediate position for a longer duration during cold engine conditions, to reduce the fuel spray penetration.

At 512, fuel is injected via the annulus nozzle and travels over the nozzle and plurality of curved fins coupled to the nozzle, thus generating a cone-shaped fuel spray that has rotational movement. Method 500 then ends.

If it is determined at 502 that no command to inject fuel is received, no signal is sent to the actuator, as indicated at 514. At 516, the injector is held or moved upward by the retention springs such that the injector nozzle is held in a first position, resulting in a closed fuel passage at 518, and thus no fuel injection.

The fuel flow to the cylinder may be regulated by the above described method of controlling the position of the fuel injector with a frustum shaped nozzle. In this way, a frustum shaped injector nozzle with tangential fins coupled to an electric actuator can be held in various positions to open or close a fuel passage, and release a cone shaped fuel spray with a counter-clockwise rotational motion to deliver air fuel mix to the cylinder of an engine.

Thus, as described above, an actuator pushes an injector needle down along a longitudinal axis, such that a fuel injector nozzle end coupled to the needle moves to a position away from an inner wall of a fuel injector body housing the needle and nozzle. The movement of face sharing surfaces of the injector body and nozzle away from each other may partially or completely open a fuel passage within the injector body to release the fuel to an annulus gap created by the increased distance between the face sharing surfaces. It may be noted that the range of downward movement of the injector nozzle, relative to inner wall of the injector body, will determine the opening, e.g. partial to complete, of the fuel passage and determine the volume of the annulus gap. The flowing fuel from the fuel passage travels over tangential fins on the nozzle to generate a curved fuel spray injection pattern. The nozzle end may be frusto-conical or other shape, such as square, triangular pentagonal etc., and have complementary face-sharing surfaces on the inner body of the injector.

Conversely, in absence of an electric signal to the electric actuator, a plurality of retention springs coupled to the injector body and the injector needle may push the needle upward along the longitudinal axis, away from the cylinder, and hold the needle in this first position. This upward movement of the injector needle along with the injector nozzle end may partially or completely block the fuel passage on the injector body, as one or more face-sharing surfaces between the injector body and the outer wall of the injector nozzle may be in complete or partial contact. In one embodiment a surface on the outer wall of the nozzle and a surface on the inner wall of the injector body are positioned such that the fuel passage inlet into the annulus gap is blocked. The first position also reduces the volume of the annulus gap, blocking the release of fuel from the annular gap into the engine cylinder.

The fuel injector body has at least one high pressure fuel passage for delivering fuel to the annulus gap, which then is distributed through the tangential fins on the outer wall of the nozzle to reach the cylinder. The fuel passage may be connected to a fuel supply system, comprising of one or more fuel storage tanks on board—the vehicle and for providing fuel to the engine. It may also include a fuel pump and a fuel rail to deliver high pressure fuel to the fuel passage on the injector body. The fuel tank may store one or more liquid fuels, including but not limited to gasoline, diesel and alcohol fuels. In some examples stored fuel maybe a mix of two or more liquid fuels.

In some examples, variable electric current may be supplied by all electric control unit (e.g., the controller described above) to the actuator of the fuel injector to provide force for a designated travel distance of the injector needle, which controls the size of the annulus nozzle. In doing so, the size of the annulus nozzle may be adjusted to deliver a larger or smaller volume of fuel, depending on operating conditions. This may allow the injector to maintain relatively equal duration of injection for all engine operation conditions. It may also allow control of the spray penetration distance (within certain distance) by adjusting nozzle size and injection duration together to achieve the desired fuel delivery quantity. This may be particularly useful during injection events for a small volume of fuel is to be injected, such as during multiple injection events where the pre or post injection event only last a very short tithe (a few milliseconds).

FIGS. 6-9 show an embodiment of a fuel injector assembly 600 with two injector needles. The fuel injector assembly 600 goes through a two-stage activation and a two-stage deactivation process to reduce fuel dripping after injector is closed, thereby reducing injector coking and subsequent degradation of emissions.

At the first stage of deactivation the fuel injector assembly 600 is held in a first position 601 shown in FIG. 6. This is followed by the first stage of activation wherein the fuel injector assembly 600 is in a second position 701, as illustrated in FIG. 7. In the second stage of activation, the fuel injector assembly 600 is in a third position 801, as depicted in FIG. 8. This is followed by a second stage of deactivation in which the fuel injector assembly 600 is in a fourth position 901 shown in FIG. 9.

Referring to FIG. 6, the deactivated fuel injector assembly 600 in a first position in an engine cylinder 626 defined by a cylinder head 602 is illustrated. The fuel injector assembly 600 may be one non-limiting example of injector 66 of FIG. 1. The fuel injector assembly 600 includes an injector body 604 housing two injector needles, a primary injector needle 608 and a secondary injector needle 620, with relative motion between them. The secondary injector needle 620 is housed partly in a passage inside the primary needle injector needle 608. The movement of the secondary injector needle 620 inside the primary injector needle 608 passage is restricted by a stop guide 610 attached to the primary injector needle 608 passage. The secondary injector needle 620 has a frustum shaped nozzle 615 with a plurality of tangential fins 621 on its outer surface. The nozzle 615 has a top surface 617 and a bottom surface 619 opposite the top surface. The bottom surface 619 faces into the interior of the cylinder 626. The bottom surface 619 may have a larger cross-sectional area than the cross-sectional area of the top surface 617.

A high pressure fuel passage 614 is present between the injector body 604 and the primary injector needle 608, which connects to a fuel sac 616 at the base of the primary injector needle 608. The high pressure fuel passage 614 has an inlet connecting to a high pressure fuel system, for example a high pressure fuel rail connected to a fuel pump and a fuel tank (not shown), and also includes an outlet for fuel discharge into the fuel sac 616.

The fuel from the fuel sac 616 can be discharged through an annular gap 618, created when the face-sharing contact is lost between the injector body 604 and the nozzle 615, described in detail below with respect to FIG. 8.

The injector body 604 includes a needle seating 612, sized and shaped such that at least a portion of the surface is in face-sharing contact with at least a portion of the primary injector needle 608, when the needle is in a first deactivated position 601, as shown in FIG. 6, thus preventing flow of fuel from the high pressure passage 614 to the sac 616.

An actuator 606 may be coupled to the primary injector needle 608. The secondary injector needle 620 may be coupled a retention spring 624. The actuator 606 may move the injector needles along the longitudinal axis 630 in a downward direction (e.g., toward the cylinder 626). In the example illustrated in FIGS. 6-10, the longitudinal axis 630 of the injector is perpendicular to a transverse axis 632 of the cylinder 626. In one embodiment of the disclosed device, an electric motor is used to move the needle to regulate fuel injection. The fuel injector may be actuated by other actuators, such as solenoid, piezoelectric, hydraulic, etc., without departing from the scope of this disclosure.

During the first closed position 601, when the fuel injector assembly is in first stage of deactivation, the actuator 606 is not activated and the primary injector needle 608 is in face-sharing contact with the needle seating 612 such that the high pressure fuel passage 614 has no fluidic communication with the low pressure fuel sac 616. At position 601, retention spring 624 biases the secondary injector needle 620 upward, in a direction away from the cylinder wall 626, such that the secondary injector nozzle 615 is in face-sharing contact with the injector body 604, at least partly closing the annular gap 618 and preventing fluidic communication of sac 616 with the cylinder 626. Consequently, fuel is blocked from exiting the sac 616, through the annular gap 618 and into the cylinder 626 and no fuel is injected into the cylinder 626.

Upon receiving a command for fuel injection, the fuel injector assembly 600 transitions to the first stage of activation and is in the second position 701, as shown in FIG. 7. At position 701, the electric actuator 606 moves the primary needle injector 608 in a direction away from the cylinder 626. This movement of the primary injector needle 608 results in loss of face-sharing contact between the needle seating 612 and the primary injector needle 608, resulting in opening of fluidic communication between the fuel passage 614 and the fuel sac 616. Accordingly, fuel is able to move from the high pressure fuel passage 614 to the sac 616. At position 701, the annular gap 618 is still closed. The retention spring 624 is holding the secondary injector needle 620 such that the face-sharing contact between the secondary injector nozzle 615 and the injector body 604 is intact, and fuel from the sac 616 cannot be injected into the cylinder wall 626.

Continuing the execution of fuel injection event, the transfer of high pressure fuel into the fuel sac 616 during position 701, increases the pressure in sac 616 which pushes the secondary injector needle 620 downwards, towards the cylinder wall 626, against the retention spring 624 bias holding the needle upward, as illustrated by the third position 801 in FIG. 8. This is the second stage of activation.

The downward movement of secondary injector needle 620 pushes the injector nozzle 615 towards the cylinder 626, away from the injector body 604. This results in loss of face sharing contact between the secondary injector nozzle 615 surface and the injector body 604 is lost. As a result, the annular gap 618 opens and fluidic communication between the sac 616 and the cylinder 626 is established, resulting in injection of fuel from the sac 616 into the cylinder wall 626. The downward movement of the secondary injector needle 620 is intercepted by the stop guides 610 attached to the wall of the primary injector needle 608, controlling the range of secondary injector needle 620 movement, thereby regulating the size of the annular gap 618 and regulating the fuel flow during position 801.

Fuel injection at position 801 provides rotational momentum to the plurality of curved fins 621 present on the surface of the secondary injector nozzle 615. In one example, the fins may be curved in such a manner as to create a fuel spray having rotational momentum in a counter-clockwise direction, as shown by arrow 625. The curved fins may generate tangential force which may rotate the secondary injector needle 620 and nozzle 615 in a counterclockwise direction generating rotational fuel spray during fuel injection thereby enhancing fuel spray atomization and reducing fuel penetration.

At the end of the two-stage activation, after a fuel injection event has been executed, the injector assembly 600 moves to the fourth position 901 which is the second stage of deactivation, as illustrated in FIG. 9. At the end of a fuel injection event, the actuator 606 pushes the primary injector needle 608 in a downward direction, towards the cylinder 626, establishing surface to surface contact between the needle seating 612 and the primary injector needle 608. This shuts off the fluidic communication between the high pressure passage 614 and the fuel sac 616 resulting in suspension of fuel supply to the fuel sac 616. At position 901, the annular gap 618 is still open due to pressure from the fuel that remains in the sac 616.

Subsequently, the pressure in fuel sac 616 drops due to closing of communication with the high pressure fuel passage. This causes the bias of the retention spring 624 to pull the secondary injector needle 620 and the injector nozzle 615 in a direction away from the cylinder 626. The surface to surface contact between the injector body 604 and injector nozzle 615 is re-established, returning the injector assembly to the deactivated first position as shown in FIG. 6, completing one fuel injection event.

In other embodiments of the fuel injector assembly, the fuel assembly may not include curved fins on the injector nozzle. FIG. 10 shows one such embodiment of a fuel injector assembly 650 with the primary injector needle 608 and the secondary injector needle 620 and frustum shaped nozzle 615, with no curved tins, is in an activated third position. During the third position of the fuel injector assembly 650, the high fuel passage is in fluidic communication with the sac 616 and the annular gap 618 is open, communicating with the cylinder wall 626, resulting in injection of high pressure fuel, as described in FIG. 8. The embodiment of the fuel injector shown in FIG. 10 can go through the four position, dual stage activation and deactivation cycle during fuel injection as described in FIGS. 6-9 thereby reducing fuel dripping and generating efficient fuel spray pattern.

FIG. 11 is a flow chart showing a method 950 for direct fuel injection by a fuel injector assembly configured for two-stage activation and de-activation, such as fuel injector assembly 600. At least portions of method 950 may be implemented as executable controller instructions stored in non-transitory memory. Additionally, portions of method 950 may be actions taken in the physical world to transform an operating state of an actuator or device, such as the actuator 606 of the fuel injector assembly. Instructions for carrying out method 950 may be executed by a controller (e.g., controller 12) based on instructions stored on a memory of the controller and in conjunction with signals received from sensors of the engine system, such as the sensors described above with reference to FIG. 1. The controller may employ engine actuators of the engine system to adjust engine operation, according to the method described below.

Method 950 starts at 952 where engine operating parameters are detected, including but not limited to detecting engine status (e.g., on or off), engine speed and load, current engine position, and other parameters. At 954, the fuel injector assembly is deactivated and in its default, first position, such as the position 601 described above with respect to FIG. 6. In the first position, both the primary needle and secondary needle are held in their respective closed positions, such that fuel is blocked from entering the fuel injector. At 956, method 950 determines if a command to inject fuel is received. Fuel may be injected in response to engine load above a threshold and/or in response to the firing order and engine position indicating that the injector is to inject fuel to initiate combustion in the cylinder. If no command to inject fuel is received, method 950 loops back to 954 and continues to hold the fuel assembly in the first position. If the command is yes, method 950 proceeds to 960 to activate an actuator (e.g., actuator 606) to move the primary needle coupled to the actuator (e.g., needle 608) from a first position to a second position. When the primary injector needle is moved to the second position, the contact between the primary injector and the needle seating is lost, and at 962, fluidic communication between a high fuel pressure passage and a fuel sac of the injector assembly is established. This causes high pressure fuel to accumulate in the sac. The method 950 then proceeds to 964.

At 964, the high pressure fuel accumulated in the sac moves a secondary injector needle (e.g., needle 620) in a downward direction, against the bias of the retention spring of the injector assembly (e.g., into the third position described above with respect to FIG. 8). This results in opening of an annular gap between a nozzle end of the secondary needle and the injector body at 966, establishing fluidic communication between the sac and the cylinder, causing the fuel from the sac to be injected to the cylinder.

At 968, method 950 determines if the end of fuel injection event is reached. The duration of the fuel injection event may be based on engine parameters such as engine speed, engine load etc. If the end of the fuel injection event is not reached, method 950 loops back to 966 to continue to inject fuel with the fuel injector assembly in the third position. If the end of the fuel injection event is reached, the method 950 deactivates the actuator, which moves the fuel assembly to the fourth position at 969 (e.g., the fourth position described above with respect to FIG. 9). In the fourth position, the primary injector needle is moved by the actuator to close the communication between the sac and the high pressure fuel passage. Once the fuel assembly is moved to the fourth position, the fuel in the sac drains out of the injector until the pressure in the sac is less than the upward force exerted by the retention spring of the fuel injector assembly, and thus the secondary needle closes resulting in end of fuel injection and return of the fuel injector assembly to the first position. Method 950 returns.

In one example, the method 950 may be executed in an embodiment of fuel injector assembly wherein curved fins may be present on the surface of the secondary injector nozzle which may produce rotational momentum to rotate the secondary fuel injector in anti-clockwise direction when the fuel assembly is held in activated third position at steps 964 and 966 of method 950, enhancing air-fuel mixing and reducing fuel penetration.

The fuel flow to the cylinder may be regulated by the above described method of controlling the position of the primary and secondary fuel injector needles such that the fuel injector assembly can be held in four positions to carry out a two-stage activation and a two-stage deactivation cycle during a fuel injection event.

The above-mentioned fuel injector assembly includes an injector with two injector needles, a primary injector needle and a secondary injector needle, with relative motion between each other. As described above, in a first position the fuel injector assembly is in first stage of deactivation. The primary injector needle is in face sharing contact with the needle seating in the injector body which closes fluidic communication between a high pressure fuel passage and the sac. The secondary injector needle is biased upwards by retention springs, away from inner cylinder wall, such that the secondary injector nozzle end is in face sharing contact with the injector body, closing the annular gap.

At a first stage of activation, upon receiving a command for fuel injection, an actuator coupled to the primary injector needle moves the needle upward, away from the cylinder, to open fluidic communication between the high pressure fuel passage and the fuel sac, holding the fuel injector assembly in a second position. At this position the annulus gap is closed with no fluidic communication between the sac and the inner cylinder wall.

At second stage of activation, the fuel injector assembly is in a third position. The movement of secondary injector nozzle in a downward direction, towards the cylinder, due to the increased pressure in the fuel sac, opens an annulus gap which releases fuel from the sac into the engine cylinder. In one example the secondary injector nozzle may have a plurality of curved fins which may impart counterclockwise rotational momentum to the secondary injector needle and the secondary injector nozzle, generating a cone shaped fuel spray, reducing fuel penetration and increasing air fuel mixing. It may be noted that the range of downward movement of the secondary injector needle and the nozzle, relative to the inner wall of the injector body, will determine the opening, e.g. partial to complete, of the annular gap. In one example, stop guides inside the primary fuel injector passage housing the secondary injector needle may determine the range of movement, thereby controlling the volume of the annulus gap.

At a second stage of deactivation, upon receiving a command for ending fuel injection, the actuator moves the primary injector needle such that the primary injector needle is in face sharing contact the needle seating on the body of the fuel injector, preventing the fuel from high pressure fuel passage from entering the sac. At this stage the bias of the retention spring moves the coupled secondary injector needle such that the annulus gap is closed due to re-establishing of face sharing contact between the secondary injector nozzle and the injector body, returning the fuel injector assembly to the deactivated first position.

Thus, a dual needle fuel injector with annulus injector nozzle is configured to move through a multi stage activation and deactivation process during a fuel injection event, thereby regulating the fuel spray pattern and reducing fuel dripping after injector is closed.

The technical effect of injecting fuel via a fuel injector having a frustum-shaped nozzle end with a plurality of curved fins is to reduce a spray penetration of the fuel while maintaining fuel-air mixing and fuel atomization, thus lowering cylinder wall-wetting, reducing fuel consumption, and improving emissions. Injecting fuel through a dual-needle fuel injector assembly with a two-stage activation and a two-stags; deactivation cycle can reduce fuel dripping, and improve fuel spray pattern and vehicle emissions. An embodiment of a fuel injector, comprising a needle and a frustum shaped nozzle end coupled to the needle. In a first example the fuel injector comprises, a plurality of curved tangential fins evenly spaced around an outer surface of the frustum shaped nozzle end. A second example of the fuel injector optionally comprises the first example and further comprises an electric actuator, the actuator configured to move the needle downward from a first, closed position to a second, open position. A third example of the fuel injector optionally comprises the first and/or second examples and further comprises a spring configured to force the needle in an upward direction in order to move the needle from the second position back to the first position when the actuator is not activated. A fourth example of the fuel injector optionally comprises one or more of each of the first through third examples and further comprises an injector body, wherein the needle is housed within the injector body. A fifth example of the fuel injector optionally comprises one or more of each of the first through fourth examples and further comprises a second needle, wherein the second needle partly houses the first needle. A sixth example of the fuel injector optionally comprises one or more of each of the first through fifth examples and further comprises the second needle coupled to an electric actuator configured to move the second needle upward from a first, closed position to a second, open position and downward from the second position to the first position. A seventh example of the fuel injector optionally comprises one or more of each of the first through sixth examples and further comprises a fuel sac intermediate the first needle and the second needle, the fuel sac fluidically coupled to a fuel passage of the fuel injector when the second needle is in the second position. An eighth example of the fuel injector optionally comprises one or more of each of the first through seventh examples and further comprises wherein the first needle is configured to move downward to a third, open position when fuel pressure in the fuel sac is greater than a threshold, and wherein the first needle is coupled to a spring configured to force the first needle in an upward direction from the third, position to a fourth, closed position when fuel pressure in the fuel sac is less than the threshold. A ninth example of the fuel injector optionally comprises one or more of each of the first through eighth examples and further comprises an injector body, the first needle and the second needle housed within the injector body. A tenth example of the fuel injector optionally comprises one or more of each of the first through ninth examples and further comprises the injector body with a needle seat having an inner surface sized and shaped such that at least a portion of the inner surface is in face-sharing contact with the second needle when the second needle is in the first position. An eleventh example of the fuel injector optionally comprises one or more of each of the first through tenth examples and further comprises at least a portion of the injector body in face-sharing contact with at least a portion of the nozzle end of the first needle, when the first needle is in the fourth position.

In another representation, a fuel injector comprises a needle; and a plurality of tangential fins coupled to a nozzle end of the needle and curved in a counter-clockwise direction. In a first example of the fuel injector, the nozzle end comprises a frustum shape and the plurality of tangential fins are coupled to an outer side surface of the nozzle end. A second example of the fuel injector optionally comprises the first example and further comprises wherein the plurality of tangential fins comprises four tangential fins evenly spaced around the outer surface of the nozzle end. A third example of the fuel injector optionally comprises the first and/or second examples and further comprises an injector body, the needle housed within the injector body. A fourth example of the fuel injector optionally comprises one or more of each of the first through third examples and further comprises wherein the injector body comprises a needle seat having an inner surface sized and shaped such that at least a portion of the inner surface is in face-sharing contact with at least a portion of the nozzle end when the needle is in a first, closed position. A fifth example of the fuel injector optionally comprises one or more of each of the first through fourth examples and further comprises an actuator coupled to the needle, the actuator configured to move the needle from the first, closed position to a second, open position. A sixth example of the fuel injector optionally comprises one or more of each of the first through fifth examples further comprises a fuel flow passage within the injector body, wherein flow of fuel through the fuel flow passage is blocked by the nozzle end when the needle is in the first position. A seventh example of the fuel injector optionally comprises one or more of each of the first through sixth examples and further includes wherein the actuator is configured to move the needle in a downward direction to move the needle from the first position to the second position. An eighth example of the fuel injector optionally comprises one or more of each of the first through seventh examples and further comprises a spring configured to force the needle in an upward direction in order to move the needle from the second position back to the first position when the actuator is not activated. A ninth example of the fuel injector optionally comprises one or more of each of the first through eighth examples and further includes wherein the actuator comprises an electric motor.

In another representation, a method for a fuel injector comprises actuating a needle housed within a body of the fuel injector to move the needle outward from a first position to a second position; and flowing fuel from a fuel passage within the body and over a plurality of curved fins on a surface of a nozzle end of the needle to generate a curved fuel injection spray pattern. A first example of the method further includes wherein actuating the needle to move the needle outward comprises activating an electric motor coupled to the needle to push the needle in a downward direction. A second example of the method optionally includes the first example and further includes deactivating the electric motor, wherein upon deactivation of the electric motor, a retention spring of the fuel injector moves the needle upward to the first position. A third example of the method optionally includes one or both of the first and second examples and further includes wherein flowing fuel from the fuel passage comprises flowing fuel from the fuel passage responsive to the needle being moved from the first position to the second position, where the nozzle end of the needle is in contact with a needle seat of a body of the fuel injector when the needle is in the first position in order to block the flowing of the fuel.

In another representation, a system comprises an engine having a cylinder; a fuel supply; a fuel injector coupled to the cylinder, and a controller. The fuel injector comprises a body having a fuel passage coupled to the fuel supply; a needle coupled to a frusto-conical nozzle end; and an actuator coupled to a needle. The controller stores non-transitory instructions in memory that when executed cause the controller to activate the actuator to move the needle to open the fuel passage and inject fuel to the cylinder. When the actuator is deactivated, the nozzle end of the needle is in contact with an inner surface of the body to block the fuel passage. The actuator moving the needle opens a fuel passage for subsequent fuel injection.

A system comprises an engine having a cylinder; a fuel supply; a fuel injector coupled to the cylinder, the fuel injector comprising: a body having a fuel passage coupled to the fuel supply; a needle housed within the body, a first, nozzle end of the needle having a frusto-conical shape and a plurality of curved fins coupled to an outer surface of the nozzle end, and an actuator coupled to a second, opposite end of the needle. The system further includes a controller storing non-transitory instructions in memory that when executed cause the controller to activate the actuator to push the needle in a downward direction responsive to a command to open the fuel passage and inject fuel to the cylinder. A first example of the system further includes wherein when the actuator is deactivated, the nozzle end of the needle is in contact with an inner surface of the body to block the fuel passage. A second example of the system optionally includes the first example and further includes wherein the actuator moves the needle in the downward direction, away from the body of the fuel injector and into the cylinder.

A fuel injector system comprises a needle; a plurality of tangential fins coupled to a nozzle end of the needle; an actuator coupled to the needle; and a controller storing non-transitory instructions that when executed cause the controller to, responsive to a command to inject fuel, activate the actuator to push the needle in a downward direction by an amount based on one or more operating parameters. In a first example of the fuel injector system, the one or more operating parameters comprise one or more of engine speed, engine load, engine temperature, and a type of fuel injection event. A second example of the system optionally includes the first example and further includes wherein the instructions cause the controller to activate the actuator to push the needle in a downward direction by a first amount, by a second amount, or by a third amount, the first amount greater than the second amount and the third amount, the second amount greater than the third amount. A third example of the system optionally includes one or both of the first example and second example and further includes wherein when a commanded fuel injection quantity is greater than a first threshold, the instructions cause the controller to activate the actuator to push the needle down by either the first amount or by the second amount. A fourth example of the system optionally includes one or more or each of the first through third examples and further includes wherein when the commanded fuel injection quantity is greater than the first threshold and when engine temperature is below a threshold temperature, the instructions cause the controller to activate the actuator to push the needle down by the second amount. A fifth example of the system optionally includes one or more or each of the first through fourth examples and further includes wherein when the commanded fuel injection quantity is less than the first threshold, the instructions cause the controller to activate the actuator to push the needle down by either the second amount or by the third amount. A sixth example of the system optionally includes one or more or each of the first through fifth examples and further includes wherein when the commanded fuel injection quantity is less than the first threshold and engine temperature is below a threshold temperature, the instructions cause the controller to activate the actuator to push the needle down by the third amount. A seventh example of the system optionally includes one or more or each of the first through sixth examples and further includes wherein the nozzle end comprises a frustum shape and the plurality of tangential fins are coupled to an outer side surface of the nozzle end. An eighth example of the system optionally includes one or more or each of the first through seventh examples and further includes wherein the plurality of tangential fins comprises four tangential fins evenly spaced around the outer surface of the nozzle end. A ninth example of the system optionally includes one or more or each of the first through eighth examples and further includes an injector body, the needle housed within the injector body. A tenth example of the system optionally includes one or more or each of the first through ninth examples and further includes wherein the injector body comprises a needle seat having an inner surface sized and shaped such that at least a portion of the inner surface is in face-sharing contact with at least a portion of the nozzle end when the needle is in a first, fully closed position. An eleventh example of the system optionally includes one or more or each of the first through tenth examples and further includes a fuel flow passage within the injector body, wherein flow of fuel through the fuel flow passage is blocked by the nozzle end when the needle is in the first position. A twelfth example of the system optionally includes one or more or each of the first through eleventh examples and further includes wherein the actuator comprises an electric motor.

A method for a fuel injector is provided, comprising actuating a needle housed within a body of the fuel injector to move the needle outward from a closed position to an open position, the needle actuated by an amount based on a designated fuel quantity and engine temperature; and flowing fuel from a fuel passage within the body and over a plurality of curved fins on a surface of a nozzle end of the needle to generate a curved fuel injection spray pattern. In a first example of the method, for a given designated fuel quantity, the needle is actuated by smaller amount when engine temperature is below a threshold temperature and is actuated by a greater amount when engine temperature is above the threshold temperature. A second example of the method optionally includes the first example and further includes wherein actuating the needle to move the needle outward comprises activating an electric motor coupled to the needle to push the needle in a downward direction, and further comprising deactivating the electric motor, wherein upon deactivation of the electric motor, a retention spring of the fuel injector moves the needle upward to the closed position. A third example of the system optionally includes one or both of the first example and second example and further includes wherein flowing fuel from the fuel passage comprises flowing fuel from the fuel passage responsive to the needle being moved from the closed position to the open position, where the nozzle end of the needle is in contact with a needle seat of a body of the fuel injector when the needle is in the closed position in order to block the flowing of the fuel.

An embodiment for a system comprises an engine having a cylinder; a fuel supply; a fuel injector coupled to the cylinder, and a controller. The fuel injector comprises a body having a fuel passage coupled to the fuel supply; a needle housed within the body, a first, nozzle end of the needle having a frusto-conical shape and a plurality of curved fins coupled to an outer surface of the nozzle end, and an actuator coupled to a second, opposite end of the needle. The controller stores non-transitory instructions in memory that when executed cause the controller to, responsive to a command to open the fuel passage and inject fuel to the cylinder, activate the actuator to push the needle in a downward direction by an amount based on designated fuel injection quantity and engine temperature. In a first example of the system, when the actuator is deactivated, the nozzle end of the needle is in contact with an inner surface of the body to block the fuel passage. A second example of the system optionally includes the first example and further includes wherein the actuator pushing the needle in the downward direction comprises the actuator pushing the needle away from the body of the fuel injector and into the cylinder.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A fuel injector coupled to an engine having a cylinder, comprising:

a needle;

a frustum shaped nozzle end coupled to the needle; and a plurality of curved tangential fins evenly spaced around an outer surface of the frustum shaped nozzle end and positioned at a tangent to a circle created by a plane through the frustum shaped nozzle end, including a plane through a top surface of the frustum shaped nozzle end, wherein the needle is coupled to an electric actuator, the electric actuator configured to move the needle downward from a first, closed position to a second, open position.

2. The fuel injector of claim 1, further comprising a spring configured to force the needle in an upward direction in order to move the needle from the second position back to the first position when the actuator is not activated.

3. The fuel injector of claim 1, further comprising an injector body, the needle housed within the injector body.

4. The fuel injector of claim 1, wherein the needle is a second needle, and further comprising a first needle, wherein the first needle partly houses the second needle.

5. The fuel injector of claim 4, wherein the first needle is coupled to the electric actuator, the actuator configured to move the first needle upward from a first, closed position to a second, open position and downward from the second position to the first position.

6. The fuel injector of claim 5, further comprising a fuel sac intermediate the second needle and the first needle, the fuel sac fluidically coupled to a fuel passage of the fuel injector when the first needle is in the second position.

7. The fuel injector of claim 6, wherein the second needle is configured to move downward to a third, open position when fuel pressure in the fuel sac is greater than a threshold, and wherein the second needle is coupled to a spring configured to force the second needle in an upward direction from the third position to a fourth, closed position when fuel pressure in the fuel sac is less than the threshold.

8. The fuel injector of claim 7, further comprising an injector body, the second needle and the first needle housed within the injector body.

9. The fuel injector of claim 8, wherein the injector body comprises a needle seat having an inner surface sized and shaped such that at least a portion of the inner surface is in face-sharing contact with the first needle when the first needle is in the first position.

10. The fuel injector of claim 8, wherein at least a portion of the injector body is in face-sharing contact with at least a portion of the nozzle end of the second needle, when the second needle is in the fourth position.

11. A method for operating a fuel injector of an internal combustion engine, comprising:

providing a plurality of curved tangential fins evenly spaced around an outer surface of a nozzle end coupled to a needle of the fuel injector and positioned at a tangent to a circle created by a plane through the nozzle end, including a plane through a top surface of the nozzle end;

actuating the needle housed within a body of the fuel injector to move the needle from a first, closed position to a second, open position; and responsive to the needle moving to the second position, flowing fuel from a fuel passage through an annulus nozzle of the fuel injector to generate a cone shaped fuel spray pattern with a counter-clockwise rotational motion with respect to a longitudinal axis of the body when viewing the nozzle end of the needle.

12. The method of claim 11, wherein actuating the needle to move the needle comprises activating an electric motor coupled to the needle.

13. The method of claim 11, wherein actuating the needle comprises actuating the needle to move the nozzle end of the needle to the second position to create the annulus nozzle, the nozzle end being frustum-shaped and comprising a plurality of curved fins on a surface of the nozzle end, and wherein flowing fuel through the annulus nozzle to generate the cone shaped fuel spray pattern with the counter-clockwise rotational motion comprises flowing the fuel over the surface and the plurality of curved fins of the nozzle end.

14. The method of claim 11, wherein the needle is a second needle, and further comprising a first needle, wherein actuating the first needle opens fluidic communication between the fuel passage and a fuel sac of the fuel injector, and wherein flowing fuel from the fuel passage through the annulus nozzle of the fuel injector comprises flowing fuel from the fuel sac over a frustum-shaped nozzle end of the second needle of the fuel injector.

15. A system, comprising:

an engine having a cylinder;

a fuel supply;

a fuel injector coupled to the cylinder, the fuel injector comprising:

a body having a fuel passage coupled to the fuel supply;

a needle housed within the body, a first, nozzle end of the needle having a frusto-conical shape;

a plurality of curved fins coupled to an outer surface of the nozzle end positioned at a tangent to a circle created by a plane through the nozzle end, including a plane through a top surface of the nozzle end; and an actuator coupled to a second, opposite end of the needle; and a controller storing non-transitory instructions in memory that when executed cause the controller to activate the actuator to push the needle in a downward direction responsive to a command to open the fuel passage and inject fuel to the cylinder.

16. The system of claim 15, wherein when the actuator is deactivated, the nozzle end of the needle is in contact with an inner surface of the body to block the fuel passage.

17. The system of claim 15, wherein the actuator pushing the needle in the downward direction comprises the actuator pushing the needle away from the body of the fuel injector and into the cylinder.

18. The fuel injector of claim 7, wherein when the first needle is in the second position and fuel pressure in the fuel sac is greater than the threshold, the second needle is in the third position and the fuel sac is fluidically coupled to both the fuel passage and to an interior of a cylinder.

* * * * *